United States Patent [19]

Schaeffler

[11] Patent Number: 4,787,347

[45] Date of Patent: Nov. 29, 1988

[54] SELF-ADJUSTING HYDRAULIC VALVE TAPPET

[75] Inventor: Georg Schaeffler, Herzogenaurach, Fed. Rep. of Germany

[73] Assignee: INA Walzlager Schaeffler KG, Fed. Rep. of Germany

[21] Appl. No.: 101,634

[22] Filed: Sep. 28, 1987

[30] Foreign Application Priority Data

Nov. 22, 1986 [DE] Fed. Rep. of Germany ..... 3639911

[51] Int. Cl.[4] ..... F01L 1/24

[52] U.S. Cl. ..... 123/90.55

[58] Field of Search ..... 123/90.46, 90.55, 90.56, 123/90.57, 90.58, 90.59, 90.63, 90.43

[56] References Cited

U.S. PATENT DOCUMENTS

| | | | |
|---|---|---|---|
| 4,465,038 | 8/1984 | Speil | 123/90.55 |
| 4,579,094 | 4/1986 | Doppling et al. | 123/90.55 |
| 4,590,898 | 5/1986 | Buente et al. | 123/90.55 |

FOREIGN PATENT DOCUMENTS

| | | | |
|---|---|---|---|
| 0197246 | 10/1986 | European Pat. Off. | 123/90.55 |
| 3409236 | 9/1985 | Fed. Rep. of Germany | 123/90.55 |
| 3437478 | 4/1986 | Fed. Rep. of Germany | 123/90.55 |

*Primary Examiner*—Willis R. Wolfe

*Attorney, Agent, or Firm*—Bierman and Muserlian

[57] ABSTRACT

A self-adjusting hydraulic valve tappet arranged in a guide bore of a cylinder head of an internal combustion engine and comprising a cup-shaped housing (1) formed by a hollow cylindrical wall (2) closed at one end by an end member (3) against the outside of which a cam abuts, a radial flange (4) provided in the bore of the hollow cylindrical wall (2) at a distance from the end member and guides for longitudinal movement of the hydraulic play compensating element (6) in a bore (5) concentric to the hollow cylindrical wall (2), characterized in that the radial flange (4) is a separate unit made of a material which has a higher thermal expansion coefficient than steel and the radial flange is inserted with its outer surface (7) in liquid-tight manner in the bore of the hollow cylindrical wall (2) and fixed therein.

8 Claims, 1 Drawing Sheet

SELF-ADJUSTING HYDRAULIC VALVE TAPPET

STATE OF THE ART

Figure 1:
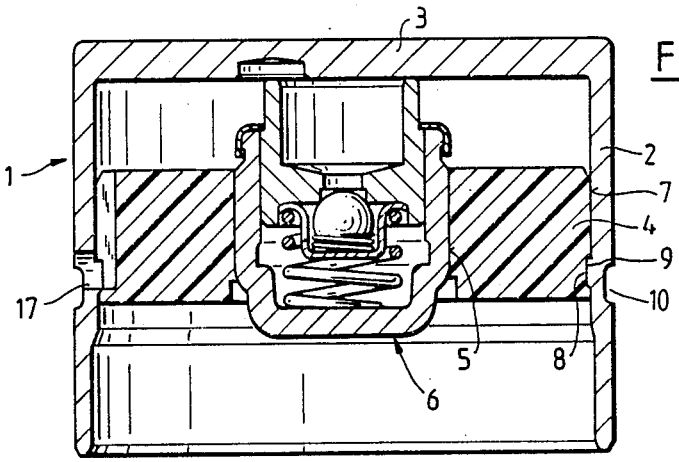

Self-adjusting hydraulic valve tappets arranged in a guide bore of a cylinder head of an internal combustion engine and comprising a cup-shaped housing formed by a hollow cylindrical wall closed at one end by an end member against the outside of which a cam abuts with a radial flange provided in the bore of the hollow cylindrical wall at a distance from the end member and guides for longitudinal movement of the hydraulic play compensating element in a bore concentric to the hollow cylindrical wall are known. U.S. Pat. No. 3,509,858 describes such a valve tappet and its cup-shaped housing together with the radial flange is made from the solid element through turning on a lathe. The cutting-type manufacture is very expensive and results in a cup-shaped housing of undesirably great mass because of the substantial wall thicknesses.

In another known design described in DE-OS No. 1,808,000, the radial flange is made as a separate structural element and is fastened in the bore of the hollow cylindrical wall. To ensure that the radial flange is sufficiently fixed with the hollow cylindrical wall, especially in a liquid-tight manner, special measures are required, namely welding, soldering or the like, which, however, were not disclosed in the known prior art.

OBJECTS OF THE INVENTION

It is an object of the invention to provide a self-adjusting hydraulic valve tappet which has an extremely small mass and is capable of being simply and economically produced.

This and other objects and advantages of the invention will become obvious from the following detailed description.

THE INVENTION

The novel self-adjusting hydraulic valve tappet of the invention is arranged in a guide bore of a cylinder head of an internal combustion engine and comprises a cup-shaped housing (1) formed by a hollow cylindrical wall (2) closed at one end by an end member (3) against the outside of which a cam abuts, a radial flange (4) provided in the bore of the hollow cylindrical wall (2) at a distance from the end member and guides for longitudinal movement of the hydraulic play compensating element (6) in a bore (5) concentric to the hollow cylindrical wall (2), characterized in that the radial flange (4) is a separate unit made of a material which has a higher thermal expansion coefficient than steel and the radial flange is inserted with its outer surface (7) in liquid-tight manner in the bore of the hollow cylindrical wall (2) and fixed therein.

The said material selection from the radial flange may be plastic material or aluminum so that the use of special fastening methods such as welding, soldering, gluing or the like is completely avoided. In the simplest case, the radial flange of the invention is provided with a completely smooth outer surface and can be pressed oversize into the smooth bore of the hollow cylindrical wall. Since the radial flange has a higher expansion coefficient than the hollow cylindrical wall, it is guaranteed that not only a loosening of this press fit can never occur even at temperature fluctuations prevailing during operation, but rather it becomes even stronger.

During production of the radial flange of plastic material, the outer annular oil reservoir is slightly reduced in comparison to conventional tappets because of the required wall thickness of the radial flange. This is advantageous because the amount of oil contained in the tappet is decreased thereby reducing the entire mass of the moveable tappet. Further, there is the advantage that this oil reservoir when being emptied during standstill of the engine is more rapidly filled during renewed starting than a larger oil reservoir, thus shortening the known rattling of the tappet in this start-up phase.

The fact that the radial flange has a higher expansion coefficient than the hollow cylindrical wall can also be utilized to attain a further advantage. Recently, the use of motor cylinder heads of light metal has become more and more common. This is disadvantageous since with increasing temperature, the cylinder head expands to a greater degree than the valve tappet which is made of steel so that the play increases between the valve tappet, on the one hand, and its receiving bore, on the other hand resulting in an undesired high oil flow Through use of the tappet construction of the invention, this drawback is circumvented or at least reduced by providing the wall thickness of the hollow cylindrical wall of such thin walled dimension at least in the longitudinal area in which the radial flange is arranged that the radial flange is capable of elastically widening the wall outwardly during heat expansion. Since the expansion coefficient of light metal, on the one hand, and suitable plastic material such as polyether sulfone is approximately alike, the play of the valve tappet in its guide bore remains at least approximately constant at all temperature ranges.

The attachment of the radial flange can be obtained for instance by providing its outer surface with a circumferential groove in which a projection of the hollow cylindrical wall engages in form-fitting manner to guarantee an even higher security. The projection of the hollow cylindrical wall may be simply provided as a circumferential enlargement which defines an oil supply groove in the outer surface of the hollow cylindrical wall.

Although usually not required, an additional seal, especially in form of an O-ring, may be provided between the bore of the hollow cylindrical wall, on the one hand, and the outer surface of the radial flange, on the other hand. In the event it is desired to reduce the cross-section of the plastic radial flange e.g. because of injection specific reasons, the radial flange may be provided with several circumferentially spaced recesses.

The construction of the invention further allows the provision of an additional safeguard against leakage from the annular oil reservoir without requiring in addition any relevant expenditures. It is only necessary to provide the radial flange in the proximity of its outer surface with a hollow cylindrical collar extending axially close to the end member and defining at least at one circumferential area together with the bore of the hollow cylindrical wall a longitudinal channel for the oil supply which communicates in the area of the radial flange with a bore leading from the oil supply groove.

Figure 2:
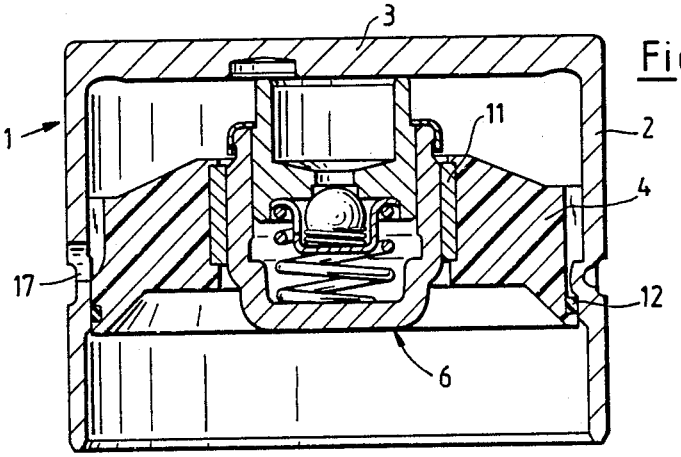
Figure 3:
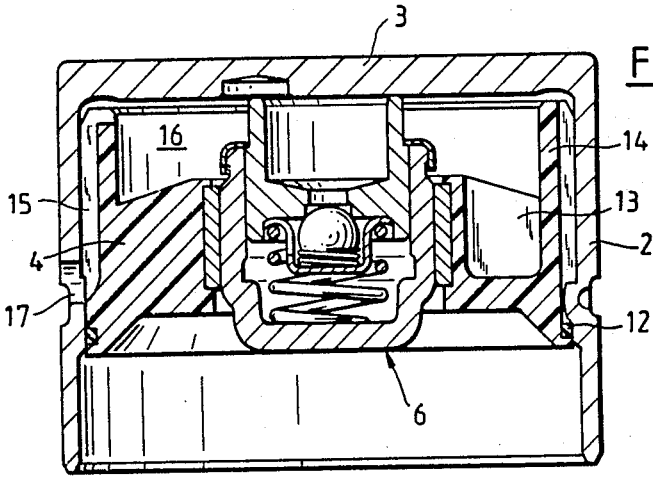

Referring now to the drawings:

FIG. 1 is a longitudinal cross-section of one embodiment of the hydraulic valve tappet of the invention and FIGS. 2 and 3 are longitudinal cross-sections of two different additional embodiments.

The valve tappet of FIG. 1 has a cup-shaped housing 1 comprised of a hollow cylindrical wall 2 closed at one end by the end member 3 and provided in the bore of the hollow cylindrical wall and spaced from the end member 3 is the radial flange 4 which guides the hydraulic play compensating element 6 for longitudinal movement in a bore 5 concentric with hollow cylindrical wall 2. While the cup-shaped housing is made of steel, the radial flange 4 is made of a polymeric material.

Attachment of the radial flange 4 in the bore of the hollow cylindrical wall 2 is obtained by providing the radial flange 4 at its outer surface 7 with a circumferential groove 8 in which a projection 9 designed as a circumferential enlargement engages This enlargement 9 simultaneously restricts an oil supply groove 10 in the outer shell surface of the hollow cylindrical wall 2. By axial pressing into the cup-shaped housing 1, the radial flange 4 is inserted in a simple manner in the bore of the hollow cylindrical wall 2 while the actual hydraulic play compensating element 6 is guided directly in a bore of the radial flange made of polymeric material.

The embodiment of FIG. 2 differs from FIG. 1 essentially in that a metallic sleeve 11 is inserted in the bore of the radial flange and this is suitable when the radial flange 4 is made of a plastic material which does not have a suitable dimensional stability and/or has unfavorable wear properties. Moreover, in the embodiment illustrated in Fig. Z, an additional seal in form of an O-ring 12 is provided between the bore of the hollow cylindrical wall 2, on the one hand, and the outer surface 7 of the radial flange 4. Such an additional seal is required only in those cases in which the polymeric material of the radial flange 4 does not have sufficient elasticity.

Finally, FIG. 3 shows a modification in which the radial flange 4 is provided at its side facing the end member 3 with several circumferentially spaced recesses 13. Also, the radial flange 4 is provided in the proximity to its outer surface with a hollow cylindrical collar 14 extending axially close to the end member 3 and defining at least at one circumferential area together with the bore of the hollow cylindrical wall 2, a longitudinal channel 15 for the oil supply into the oil reservoir 16, Communicating with the longitudinal channel 15 in the area of the radial flange 4 is a bore 17 which extends from the oil supply groove 10.

Various modifications of the valve tappet of the invention may be made without departing from the spirit or scope thereof and it is to be understood that the invention is intended to be limited only as defined in the appended claims.

What I claim is:

1. A self-adjusting hydraulic valve tappet arranged in a guide bore of a cylinder head of an internal combustion engine and comprising a cup-shaped housing (1) formed by a hollow cylindrical wall (2) closed at one end by an end member (3) against the outside of which a cam abuts, a radial flange (4) provided in the bore of the hollow cylindrical wall (2) at a distance from the end member and guides for longitudinal movement of the hydraulic play compensating element (6) in a bore (5) concentric to the hollow cylindrical wall (2) and formed as a separate unit inserted in liquid-tight manner in the bore of the hollow cylindrical wall (2) and fixed therein, characterized in that the radial flange (4) is made of a material which has a higher thermal expansion coefficient than steel and the wall thickness of the hollow cylindrical wall (2) is thin walled at least in the longitudinal area in which the outer surface of the radial flange (4) is arranged so that during heat expansion, the radial flange (4) is capable of elastically widening the wall (2) outwardly.

2. A valve tappet of claim 1 wherein the higher thermal expansion coefficient is approximately that of aluminum.

3. A valve tappet of claim 1 wherein an additional seal especially in the form of an O-ring (12) is provided between the bore of the hollow cylindrical wall (2) and the outer surface (7) of the radial flange (4).

4. A valve tappet of claim 1 wherein the radial flange (4) is provided with several circumferentially spaced recesses (13).

5. A valve tappet of claim 1 wherein the radial flange (4) is provided in the vicinity of its outer surface (7) with a hollow cylindrical collar (14) extending axially close to the end member (3) and defining at least one circumferential area together with the bore of the hollow cylindrical wall (2), a longitudinal channel (15) for the oil supply which channel communicates in the area of the radial flange (4) with a bore (17) extending from the oil supply groove (10).

6. A valve tappet of claim 1 wherein the radial flange (4) is provided at its outer surface (7) with a circumferential groove (8) which engages a projection (9) of the hollow cylindrical wall (2) in a formfitting manner.

7. A valve tappet of claim 6 wherein the projection of the hollow cylindrical wall (2) is a circumferential enlargement (9) which restricts an oil supply groove (10) in the outer surface of the hollow cylindrical wall (2).

8. A valve tappet of claim 6 wherein the radial flange (4) is provided with several circumferentially spaced recesses (13).

* * * * *